US006879208B2

(12) United States Patent
Wilson et al.

(10) Patent No.: US 6,879,208 B2
(45) Date of Patent: Apr. 12, 2005

(54) MULTI-STAGE COLLECTOR HAVING ELECTRODE STAGES ISOLATED BY A DISTRIBUTED BYPASS CAPACITOR

(75) Inventors: Robert Wilson, Maldon (GB); Steven Bardell, Great Dunmow (GB); Timothy A Crompton, Tiptree (GB)

(73) Assignee: Marconi Applied Technologies, Limited, London (GB)

( * ) Notice: Subject to any disclaimer, the term of this patent is extended or adjusted under 35 U.S.C. 154(b) by 9 days.

(21) Appl. No.: 10/203,118

(22) PCT Filed: Feb. 5, 2001

(86) PCT No.: PCT/GB01/00452

§ 371 (c)(1),
(2), (4) Date: Nov. 18, 2002

(87) PCT Pub. No.: WO01/57906

PCT Pub. Date: Aug. 9, 2001

(65) Prior Publication Data

US 2003/0090208 A1 May 15, 2003

(30) Foreign Application Priority Data

Feb. 4, 2000 (GB) ..... 0002523

(51) Int. Cl.[7] ..... H01J 23/027
(52) U.S. Cl. ..... 330/45; 315/5.38; 315/5.37
(58) Field of Search ..... 315/5.38, 5.37; 330/44, 45

(56) References Cited

U.S. PATENT DOCUMENTS 3,993,925 A * 11/1976 Achter et al. ..... 315/5.38
4,480,210 A * 10/1984 Preist et al. ..... 315/5.37 X
5,536,992 A * 7/1996 Crompton ..... 315/5.37 X
5,684,364 A * 11/1997 Heppinstall et al. ..... 315/5.38

FOREIGN PATENT DOCUMENTS

EP 1024517 * 8/2000
FR 2771215 * 5/1999

* cited by examiner

*Primary Examiner*—Benny T. Lee
(74) *Attorney, Agent, or Firm*—Kirschstein, et al.

(57) ABSTRACT

In a multistage collector used in a linear beam tube such as an IOT or klystron, electrode stages are separated by ceramic rings having metallised surfaces to provide distributed bypass capacitors. This eliminates or reduces leakage or any radio frequency energy from the interior of the collector to the outside.

14 Claims, 2 Drawing Sheets

MULTI-STAGE COLLECTOR HAVING ELECTRODE STAGES ISOLATED BY A DISTRIBUTED BYPASS CAPACITOR

BACKGROUND OF THE INVENTION

This invention relates to collectors for electron beam tubes.

Linear electron beam tubes are used for the amplification of rf signals. They incorporate an electron gun for the generation of an electron beam of the appropriate power. The electron gun has a cathode heated to a high temperature so that the application of an electric field results in the emission of electrons, the electric field being produced by spacing an anode in front of and some distance from the cathode. Typically, the anode is held at around potential and the cathode at a large, for example, several tens of kilovolts, negative potential.

In one type of linear beam tube called an Inductive Output Tube (IOT), a grid is placed close to and in front of the cathode and an rf signal to be amplified is applied between the cathode and grid so that the electron beam generated in the gun region is density modulated. The density modulated electron beam is directed through an rf interaction region which includes one or more resonant cavities. The beam may be focussed by magnetic means, to ensure that it passes through the rf region, and delivers power at an output section where the amplified rf signal is extracted.

After passing through the output section the beam enters a collector where it is collected and the remaining power on it is dissipated. The amount of power needing to be dissipated depends upon the efficiency of the linear beam tube, this being the difference between the power of the beam generated at the electron gun region and the rf power extracted in the output coupling of the rf region.

A collector may consist of a single conductive component, usually of copper, which operates at ground potential or close to ground potential. It is known to improve the overall efficiency of an amplifier tube by using a collector consisting of a number of electrically isolated stages each operating at a respective potential at or between ground and cathode potential. In one such typical arrangement for a high power klystron used for the amplification of television signals at uhf frequencies the collector has 5 stages, the difference in potential between the various stages being 25% of the beam voltage. By using such a multi-stage collector, the electrons in the beam are slowed down before impacting on the electrode surfaces thus leading to greater recovery of energy. Collectors may of course have a different number of stages operating at different potentials to effect an energy saving.

SUMMARY OF THE INVENTION

According to a first aspect of the invention, a multi-stage collector for an electron beam tube comprises: at least two electrode stages with a dielectric ring located between them, the ring having a respective metal plate on each of its end faces electrically connected to respective different stages such that they act together with the ring to define a high frequency distributed bypass capacitor.

The ring is an annulus, the radial distance between its outer and inner peripheries being equal to or greater than the axial distance between its end faces. This is in contrast to a conventional arrangement in which electrical insulation between adjacent electrode stages is provided by a dielectric cylinder having a significant axial length compared to the thickness of its wall. By using the invention, the ring enables a high capacitance to be achieved as the distance between the plates is small compared to their surface area. Thus the combination of the ring and the metal plates is able to perform as a bypass capacitor which is effective as a low impedance at high frequencies. The electron beam entering the collector is modulated by rf current components, generating rf voltages in the collector region. This can result in rf leakage occurring from the inside of the collector to the outside of the collector through insulators separating collector stages. Use of the invention permits rf leakage through the insulators to be reduced or eliminated compared to a conventional construction. Preferably the ring is of a ceramic material, but other forms of insulator may be suitable.

In a preferred embodiment, at least one of the metal plates consists of a metallisation layer, which may be laid down accurately using well known techniques. However, the metal plates could instead comprise separately fabricated components which are then fixed to the surface of the ring.

Advantageously, at least one of the metal plates does not extend to the inner and outer peripheries of the face on which it is located. Thus, in addition to the axial thickness of the ring providing a certain path length between components at different electrical potentials, there is also the distance between the edge of the metal plate and the periphery. It is therefore possible to obtain the same voltage hold-off with the dielectric ring as would be possible with a dielectric cylinder of greater axial length. This also provides a more compact collector in the axial direction.

The invention maybe applied to a collector formed as a single piece, with the dielectric ring being located between the collector and the body of the tube to which it is fixed. The distributed bypass capacitor is thus defined by the collector body, ring and tube body. Thus, a further aspect of the invention provides an electron beam tube comprising two stages, one of which is a collector, with a dielectric ring between them, the ring having a respective metal plate on each of its end faces electrically connected to the respective stages such that, together with the ring, they define a high-frequency bypass capacitor. This arrangement may be advantageous where the collector is operated at depressed voltage to give improved energy efficiency.

BRIEF DESCRIPTION OF THE DRAWINGS

One way in which the invention may be performed is now described by way of example in which.

DETAILED DESCRIPTION OF THE PREFERRED EMBODIMENTS

Figure 1A:
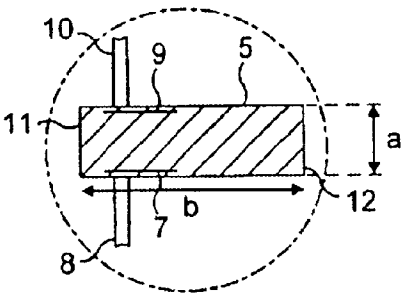
FIG. 1A is an enlarged part of FIG. 1.
Figure 1:
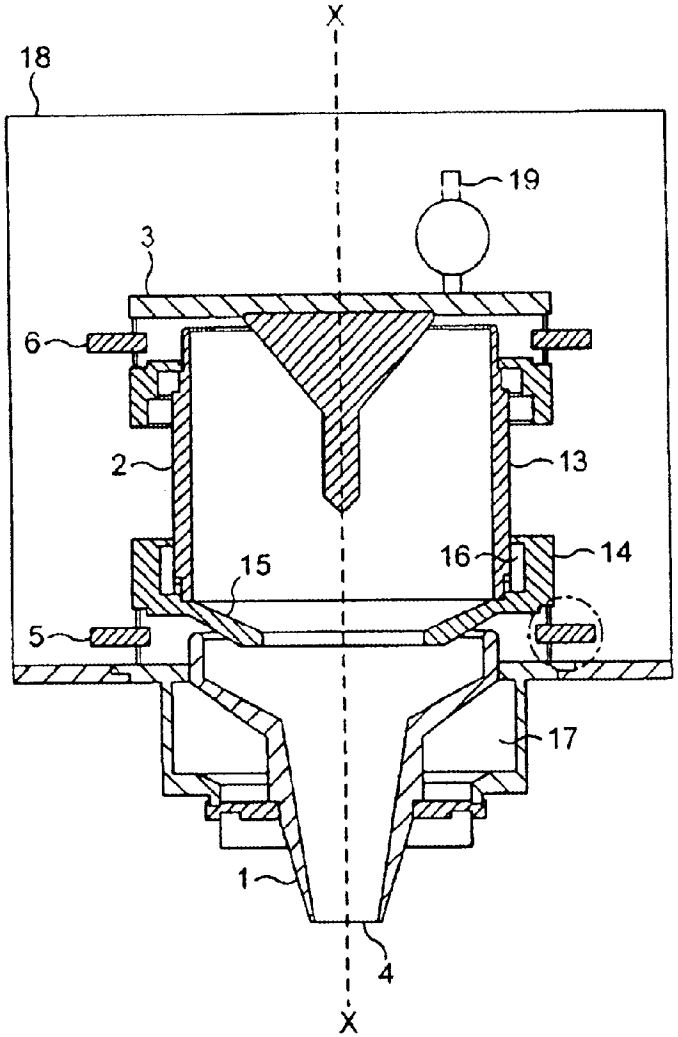
FIG. 1 schematically shows a multi-stage collector in accordance with a first aspect of the invention.

With reference to FIG. 1, a multi-stage electron beam collector includes a first electrode stage 1, second electrode stage 2 and a third electrode stage 3 arranged along a longitudinal axis X—X along which, during use, an electron beam enters the collector at opening 4 of the first stage 1, which also acts as the output drift tube.

A ceramic annular ring 5 is located between the first stage 1 and second stage 2 and another annular ceramic ring 6 between stages 2 and 3. As can be seen in FIG. 1A, the ring 5 includes a region of metallisation 7 on an end face. The metallisation is in electrical contact with a thin cylindrical metal wall 8 which is as at the same potential as the first stage 1 and thus effectively forms part of the first collector stage. Similarly, on the opposing end face of the ring 5 another layer of metallisation 9 is in electrical contact with a thin cylindrical wall 10 which forms part of the second stage 2. The ring 6 between the second and third stages 2 and 3 also has metallisation on its opposing end faces which are in electrical contact with those stages. The electrode stages 1, 2 and 3 and intervening ceramic rings 5 and 6 together define a vacuum envelope. The thin cylindrical walls adjoining the metallisation on the rings 5 and 6 form vacuum seals and are sufficiently flexible to accommodate any movement during temperature changes so as to maintain integrity of the vacuum seals in these regions.

The ring 5 has an axial extent a which is significantly shorter than the distance h in a radial direction between the inner periphery 11 and the outer periphery 12. The other ring 6 has similar dimensions. The axial extent a is chosen to be great enough to provide sufficient dielectric material to withstand the voltage between collector stages 1 and 2.

As can be seen in FIG. 1A, the metallisation 7 and 9 on the end faces of the ring 5 do not extend across the whole of the surface of those faces. This allows a longer path length from the edge of the metallisation 9 near periphery 11 to the edge of the metallisation 7 near the periphery 11, to give a desired voltage hold-off. As can be seen, the distance between the metallisation 7 and 9 and the outer periphery 12 is larger to achieve the same voltage hold-off because this region is located outside the vacuum envelope.

In this embodiment, the layers of metallisation 7 and 9 together with the thickness a of ceramic material between them together act as a distributed bypass capacitor to prevent leakage of high frequency energy from the interior of the collector and withstand the inter collector voltage while minimizing the axial extent of the collector.

As can be seen in FIG. 1, the second stage 2 comprises a generally cylindrical component 13 and a second component 14 electrically and mechanically connected thereto which has an inclined surface 15 which in use receives the electrons from the beam. The components 13 and 14 together define a passageway 16 through which water flows to provide cooling. A cooling channel 17 is also provided around the first stage 1. The collector is surrounded by an outer container 18 at ground potential and is connected to an ion pump 19 to maintain vacuum.

During use, the stages 1, 2 and 3 are operated at different electrical potentials and any rf energy appearing within the collector is prevented from leaving that region by the distributed by-pass capacitors formed by the ceramic rings 5 and 6 and associated metal plates.

Figure 1B:
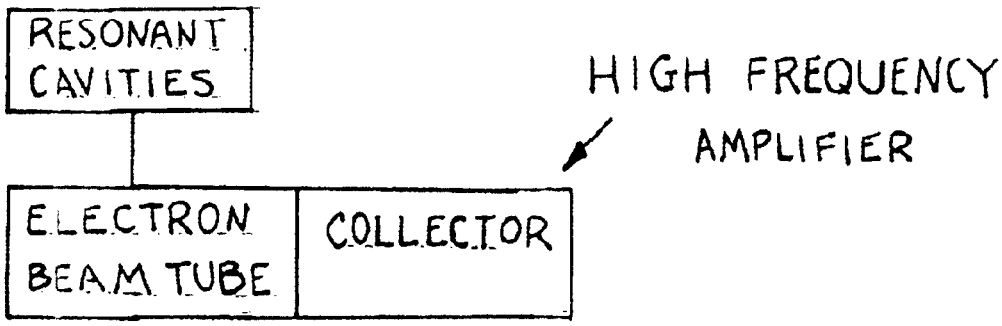
FIG. 1B is a simplified diagram of an amplifier including an electron beam tube in accordance with this invention and at least one resonant cavity.

The collector may be used with an IOT, klystron, travelling wave tube or any other electron beam tube device in which it is necessary to collect an electron beam such as a high frequency amplifier, as can be seen in FIG. 1B, including one or more high frequency resonant cavities.

Figure 2:
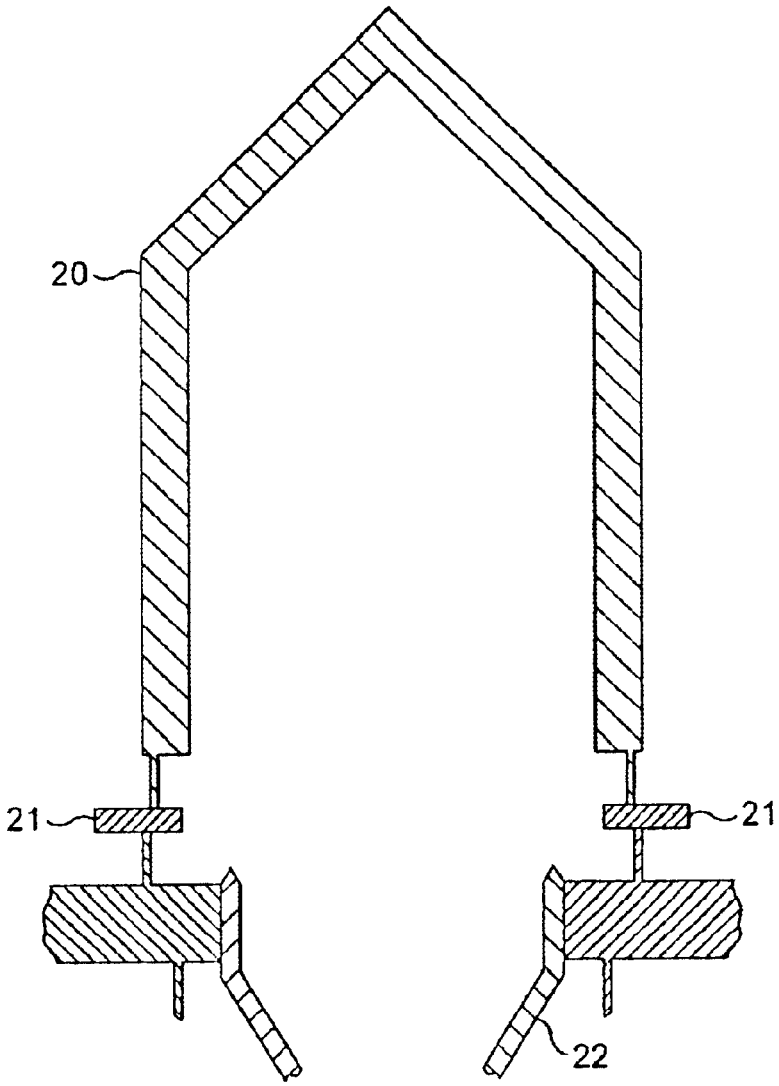
FIG. 2 schematically shows a portion of an electron beam tube constructed in accordance with a second aspect of the invention.

FIG. 2 illustrates an alternative aspect of the invention, in which the collector 20 is formed as a single piece. A ceramic annular ring 21 is located between the collector 20 and the main body 22 of the electron beam tube. The construction of the ceramic annular ring 21, and its electrical connection to the two main stages 20, 21 of the electron beam tube are similar to that shown in FIG. 1A.

What is claimed is:

1. A high frequency amplifier, comprising: an electron beam tube having one or more high frequency resonant cavities, and a collector including at least two electrode stages; and a respective dielectric ring located between the at least two electrode stages, the respective dielectric ring having corresponding end faces and a respective metal plate on each of the end faces electrically connected to respective different ones of the at least two electrode stages such that, together with the respective dielectric ring, a corresponding high frequency distributed bypass capacitor of large capacitance at high frequency is defined.

2. A multi-stage collector for an electron beam tube, comprising: at least two electrode stages; and a respective dielectric ring located between the at least two electrode stages, the respective dielectric ring having corresponding end faces and a respective metal plate on each of the end faces electrically connected to respective different ones of the at least two electrode stages such that, together with the respective dielectric ring, a corresponding high frequency distributed bypass capacitor of large capacitance at high frequency is defined.

3. The collector as claimed in claim 2, wherein at least one of the respective metal plates consists of a metallization layer.

4. The collector as claimed in claim 2, wherein the respective dielectric ring has an axial length which is shorter than a radial distance between inner and outer peripheries of the respective dielectric ring.

5. The collector as claimed in claim 2, wherein at least one of the respective metal plates terminates short of inner and outer peripheries of the end face on which said at least one metal plate lies.

6. The collector as claimed in claim 2, wherein the at least two electrode stages and the respective dielectric ring are part of a vacuum envelope.

7. The collector as claimed in claim 6, wherein the at least two electrode stages contact the respective metal plates at a location which is closer to an inner periphery than an outer periphery of the respective dielectric ring.

8. The collector as claimed is claim 2, wherein one of the electrode stages comprises two components, and wherein one of the components is interposed between the other of the components and the respective dielectric ring.

9. The collector as claimed in claim 8, wherein a passage exists between the two components to provide a path for coolant fluid.

10. The collector as claimed in claim 2, wherein the respective dielectric ring is comprised of a ceramic material.

11. An electron beam tube, comprising a collector including at least two electrode stages; and a respective dielectric ring located between the at least two electrode stages, the respective dielectric ring having corresponding end faces and a respective metal plate on each of the end faces electrically connected to respective different ones of the at least two electrode stages such that, together with the respective dielectric ring, a corresponding high frequency distributed bypass capacitor of large capacitance at high frequency is defined.

12. An electron beam tube, comprising: two stages, one of the two stages being a collector; and a dielectric ring between the stages, the dielectric ring having end faces and a respective metal plate on each of the end faces electrically connected to the respective stages such that, together with the dielectric ring, a high frequency distributed bypass capacitor of large capacitance at high frequency is defined.

13. The electron beam tube as claimed in claim 12, wherein at least one of the metal plates consists of a metallization layer.

14. The electron beam tube as claimed in claim 12, wherein the dielectric ring has an axial length shorter than a radial distance between inner and outer peripheries of the dielectric ring.

* * * * *